US005558258A

United States Patent [19]

Albini et al.

[11] Patent Number: 5,558,258

[45] Date of Patent: Sep. 24, 1996

[54] DISPENSER FOR DISPENSING ATOMIZED FLUIDS UNDER PRESSURE, PROVIDED WITH A SHUT-OFF ELEMENT OPERATED BY THE PRESSURIZED FLUID

[75] Inventors: Giovanni Albini; Tommaso Ruscitti, both of Milan; Franco Carlappi, Pianello Valtidone, all of Italy

[73] Assignee: TER S.r.l., Milan, Italy

[21] Appl. No.: 401,902

[22] Filed: Mar. 10, 1995

[30] Foreign Application Priority Data

May 25, 1994 [IT] Italy ..... MI94A1061

[51] Int. Cl.[6] ..... B05B 1/30

[52] U.S. Cl. ..... 222/496; 222/380

[58] Field of Search ..... 222/380, 496

[56] References Cited

U.S. PATENT DOCUMENTS

| | | | |
|---|---|---|---|
| 2,717,178 | 9/1955 | Cornelius . | |
| 4,182,496 | 1/1980 | Burke | 239/492 |
| 4,723,725 | 2/1988 | Comment | 222/496 X |
| 5,195,665 | 3/1993 | Lina | 222/380 X |
| 5,197,638 | 3/1993 | Wood | 222/496 X |
| 5,273,191 | 12/1993 | Meshberg | 222/496 X |

FOREIGN PATENT DOCUMENTS 1750186 1/1971 Germany .

*Primary Examiner*—Andres Kashnikow
*Assistant Examiner*—Kenneth Bomberg
*Attorney, Agent, or Firm*—Oblon, Spivak, McClelland, Maier & Neustadt, P.C.

[57] ABSTRACT

A dispenser for dispensing atomized fluids under pressure and provided with a shut-off element operated by the pressurized fluid. The dispenser includes a compression chamber housing a movable piston from which there projects an appendix which, when in a rest state, is urged by a spring to seal a discharge hole provided in a body closing the chamber, which communicates with a seat into which the end of the stem of a pressurized fluid pump can be inserted. When the fluid pressure within the chamber overcomes the resistance of the spring, the piston moves and the appendix frees the discharge hole. That end of the piston close to the appendix is slidable in a sealed manner within a cavity in a bush and a communication duct between the compression chamber and the discharge hole is freed only when the end of the piston emerges from the bush cavity on withdrawing.

4 Claims, 1 Drawing Sheet

DISPENSER FOR DISPENSING ATOMIZED FLUIDS UNDER PRESSURE, PROVIDED WITH A SHUT-OFF ELEMENT OPERATED BY THE PRESSURIZED FLUID

BACKGROUND OF THE INVENTION

1. Field of the Invention

This invention relates to a dispenser for dispensing atomized fluids under pressure, provided with a shut-off element operated by the action of the pressurized fluid.

2. Discussion of the Background

To dispense pressurized liquids in finely atomized form it is known to use manually operated pumps with a hollow liquid exit stem on which a dispensing head is mounted incorporating a chamber at which the pressurized liquid arrives from the pump stem. The pressurized liquid is dispensed in atomized form after passing through a discharge hole in which a series of spiral channels are provided leading to a chamber wherein the fluid undergoes a strong swirling movement before being expelled to atmosphere.

To achieve good and constant atomization without liquid dripping from the outside of the discharge hole the liquid pressure at this hole, when dispensing commences, must be sufficiently high from the beginning. This problem has been previously partially solved by constructing and using pumps from which the liquid emerges only when its pressure is sufficiently high.

Such pumps are, however, of rather complex structure and their cost is fairly high. In addition the liquid delivered by the pump tends to lose pressure as dispensing commences, in traversing the various passages provided in the dispensing head.

If the fluids to be dispensed tend to dry, so obstructing fluid passage through the discharge hole (which very easily happens, for example, if the fluid is hair lacquer, dressing fluid or the like), the discharge hole must be closed on termination of each dispensing operation in order to isolate from the air the fluid residues present between the pump and the discharge hole in the dispensing head.

To overcome this problem, U.S. Pat. No. 4,182,496 describes a dispensing head having a compression chamber housing a slidable piston with an appendix extending towards a discharge hole provided in an insert delimiting the compression chamber. Acting on the piston there is a spring which when under rest conditions urges its free end against said insert to hermetically seal the discharge hole, hence isolating any fluid present in said chamber from contact with the air. When the pump is operated, the pressurized fluid reaching said chamber causes the piston to move against the action of the spring, with consequent withdrawal of the free end of its appendix from the discharge hole.

The dispensing head of U.S. Pat. No. 4,182,496 and that (analogous but less sophisticated) represented in DE-A-1750186 have the drawback that even if the liquid reaches a high pressure in the compression chamber before the movable piston begins to move from its rest position by overcoming the action of the spring which acts on it, there is in any event some dripping of the liquid (consequent from a considerable reduction in its pressure) passing through the discharge hole on commencement of dispensing (with consequent formation of incrustations on the outside of the discharge hole). A similar negative phenomenon occurs immediately before the piston appendix closes the discharge hole on termination of each delivery.

In this respect, on commencement of dispensing, when a certain pressure is reached in the compression chamber the piston begins to gradually move, with gradual withdrawal of the end of its appendix from the discharge hole to gradually open liquid passage to the discharge hole. The discharge hole is completely free only after the free end of the piston appendix has moved sufficiently far from it. However before this position is reached a certain quantity of liquid will already have emerged through a narrow path causing it to lose pressure.

The reverse phenomenon occurs when delivery ceases.

SUMMARY OF THE INVENTION

The main object of the present invention is therefore to provide a dispenser of the aforesaid type, i.e. able to hermetically seal the dispenser discharge hole when under rest conditions while simultaneously ensuring a substantially constant pressure of the dispensed fluid, both during opening and during closure, hence preventing fluid dripping.

A further object is to provide a dispenser of the aforesaid type which can also be used with very simple and inexpensive mechanical pumps, which may deliver their pumped fluid at non-constant pressure.

Finally, a further object is to provide a dispenser which enables fluid dispensing to commence in a sudden manner to cause expulsion of any substances which may have previously been deposited in the discharge hole.

These and further objects are attained by a dispenser comprising a hollow head provided with a seat for its connection onto the free end of the stem of a pump and in which there is provided an elongate compression chamber in communication with said seat and delimited at one end by a body traversed by a hole through which fluid is discharged into the atmosphere, said chamber movably housing a piston provided with a seal lip which delimits the other end of the compression chamber, from said piston there projects an appendix the free end of which, when in a rest position into which it is urged by a spring housed in said hollow head and acting on the piston, closes said discharge hole, said appendix being withdrawable from said hole and into a dispensing position, by the action of a pressurized fluid fed into said chamber and acting on the piston against the action of said spring to allow the pressurized fluid to emerge in an atomized state from said chamber through said discharge hole, characterised in that the cavity of said head houses a bush traversed by a hole into which said piston appendix is inserted and through which it extends, from said bush there extending a tubular wall defining a cavity in which a portion of the piston close to said appendix can be inserted and can slide in a sealed manner, the length of said tubular wall and of said piston being such that the cylindrical portion of the piston emerges from the cavity delimited by the tubular wall of the bush only after undergoing an extent of travel sufficient to enable said appendix to withdraw from said discharge hole to allow free emergence of the pressurized liquid originating from said compression chamber through at least one channel provided within said bush and closable by the piston.

BRIEF DESCRIPTION OF THE DRAWINGS

The structure and characteristics of the dispenser according to the present invention will be more apparent from the description of one embodiment thereof given hereinafter by way of non-limiting example with reference to the accompanying drawing, in which.

DESCRIPTION OF THE PREFERRED EMBODIMENTS

Figure 1:
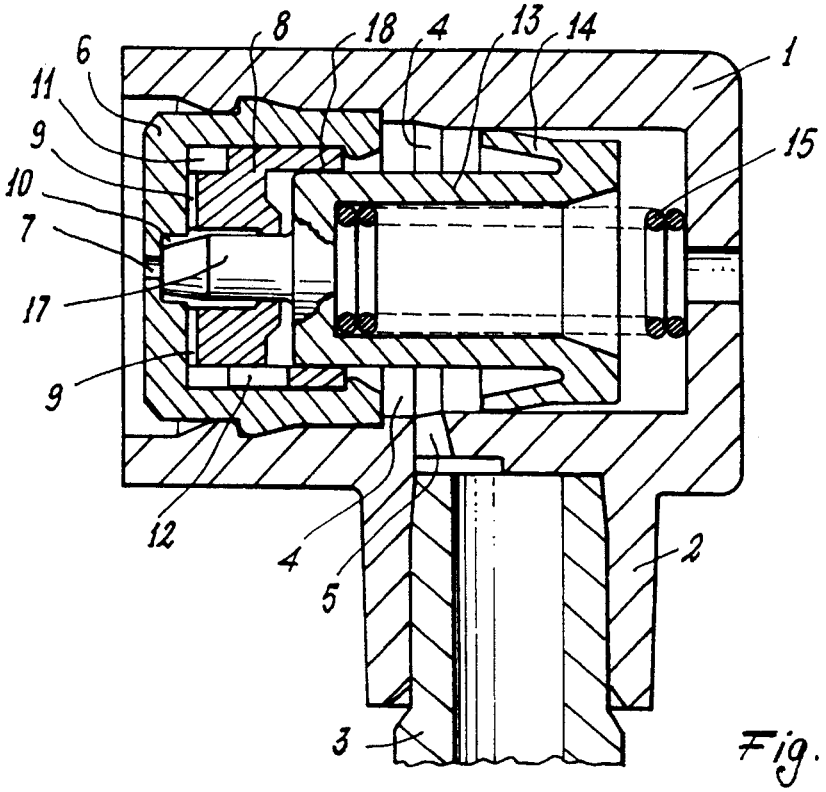
FIG. 1 is a longitudinal sections view taken through the dispenser in its rest position.

The dispenser shown on the drawing comprises a hollow head 1 provided with a seat (defined by a tubular wall 2) into which the free end of the hollow stem 3 of a mechanical pump (not shown), of any known type able to deliver fluids under pressure each time it is manually operated, is inserted and retained.

In the head 1 there is provided a compression chamber 4 which communicates with the said seat via a hole 5. The cavity of the head 1 is closed by a body 6 (which is inserted into and snap-locked within the cavity, as is clear from the figures) traversed by a hole 7 through which the atomized fluid is discharged into the atmosphere, as explained hereinafter.

The body 6 houses and retains a bush 8 which, in that surface thereof resting against the body 6, comprises spiral channels 9 leading to a central chamber 10 immediately upstream of the hole 7. At their outer end the channels 9 open into an annular chamber 11 into which there open one or more passages 12 passing through the bush 8.

The cavity in the head 1 houses a piston 13 which can slide therein and is provided with a lip 14 which sealingly slides against a corresponding cylindrical surface of the cavity within the head 1. As can be seen from the drawing, on the piston 13 there acts a compressed spring 15 the force of which determines the delivery pressure of the fluid expelled from the hole 7. Finally, it can be seen that from that end of the piston 13 facing the body 6 there projects an elongate appendix 17 passing in a sealed manner through a hole provided in the bush 8 and having its free end urged (when the dispenser is in its rest state as shown in FIG. 1) against the body 6, to hermetically seal the discharge hole 7.

The dispenser structure described up to this point is substantially analogous to that of U.S. Pat. No. 4,182,496.

An essential fundamental characteristic of the dispenser according to the present invention is that from the bush 8 there extends a tubular wall 18 defining a cylindrical cavity in which a cylindrical portion of the piston 13 close to the appendix 17 can be inserted and slide under sealed conditions.

To clearly illustrate the characteristics of the dispenser reference will now be made to the figures to explain its operation.

It will be assumed that it is in the rest state shown in Figure in which the free end of the appendix 17 hermetically seals the hole 7, to hence completely isolate any fluid residue present in the central chamber 10 from contact with the air. When in this state the chamber 10, the annular chamber 11 and the passages 12 do not communicate with the compression chamber 4 because said piston cylindrical portion seals against the inner surface of the tubular wall 18 of the bush 8.

It will now be assumed that the head 1 is lowered (with respect to the figure) and with it the stem 3. This causes operation of the pump of which the stem forms part, with the result that the pressurized fluid delivered by the pump and rising along the stem 3 into the compression chamber 4 acts on the piston 13, 14 to cause it to move towards the right (with respect to the figures of the drawing), compressing the spring 15. Together with the piston there also moves the appendix 17, which withdraws from the hole 7 to retract into the chamber 10.

Figure 2:
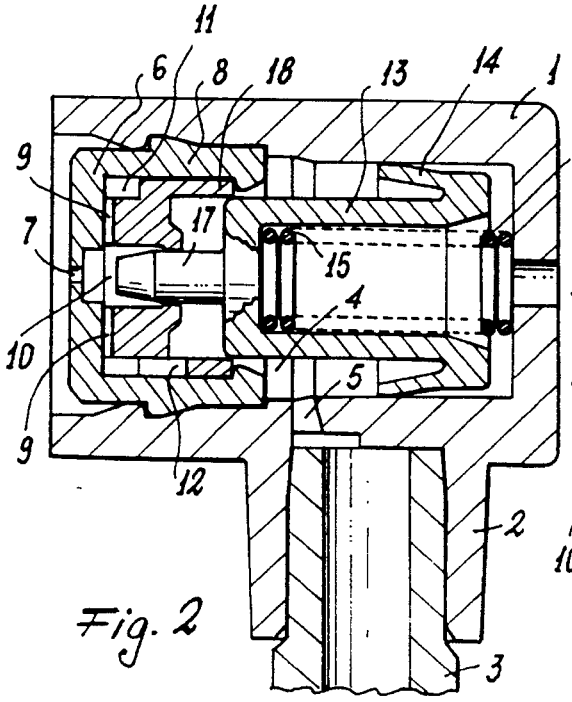
FIGS. 2 and 3 respectively show the same dispenser in an intermediate position and respectively in the final position which it assumes when dispensing the fluid.

In the initial stage of the piston movement, while there is sealed contact between the piston and the tubular wall 18 of the bush (FIG. 2) there is no communication between the compression chamber 4 and the chamber 10, from which, however, the appendix 17 is retracted.

Figure 3:
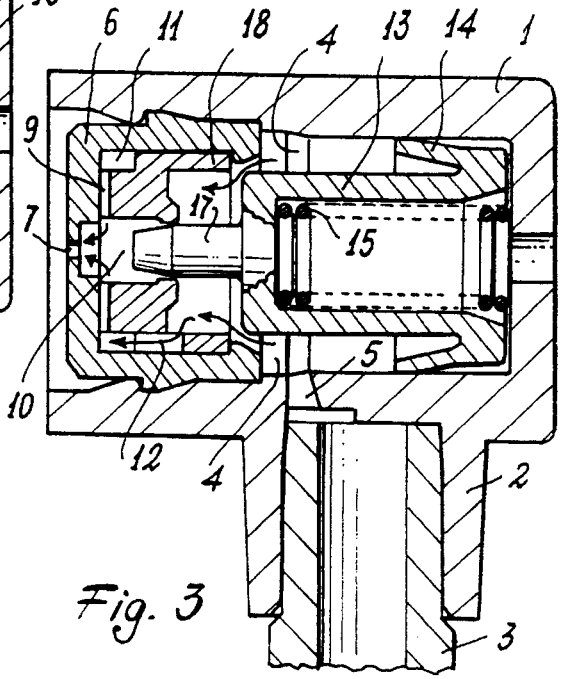

As the piston continues to move towards the right (FIG. 3), when a predetermined pressure is attained in the chamber 4 the piston is completely freed from the tubular wall 18 and the pressurized fluid penetrates violently into the chamber 10 (and is hence expelled to the outside of the hole 7 in finely atomized form, at high pressure from the very commencement of dispensing) after traversing the passages 12, the chamber 11 and the channels 9.

It will be noted that at the moment in which the piston 13 is freed from the tubular wall 18 a free annular passage of relatively large dimensions is immediately created, in that its minimum diameter corresponds to the outer diameter of the piston, which is relatively large. Hence the dimensions of this annular passage are immediately much larger than the dimensions of the chamber 10 (which has already been freed by the appendix 17).

The result is that the pressurized fluid penetrates violently at high pressure (there are practically no relevant constrictions) into the chamber 10, from which it is expelled at high velocity to remove any residues present in the chamber or in proximity to the discharge hole.

Likewise, during closure, communication between the chamber 4 and the chamber 10 is initially and very suddenly interrupted, resulting in immediate loss of fluid pressure within the chamber 10. Only subsequently (although after only an infinitessimally short time) does the free end of the piston 13 close the hole 7, any fluid residues present in the chamber 10 (which is practically completely occupied by the appendix 17) being pushed out of the hole 7, as to prevent the formation of dangerous incrustations.

It can be seen that that end of the piston facing the bush, and the bush itself, can be shaped to form an obstacle to be overcome snap-wise an instant before the piston is freed from the tubular wall of the bush, in order to increase the "shooting" effect of the pressurized liquid to the chamber 10 and to discharge. This can be achieved for example by conically shaping the opposing cooperating surfaces of the piston and tubular wall, or by forming a small annular rib, with a respective corresponding annular groove, in one and the other of the two parts.

It is very important to note that the described dispenser can be also applied to pumps of very simple and inexpensive structure, even those without the (costly) expedients necessary to ensure that the pumped fluid is delivered only after a predetermined pressure has been exceeded.

Moreover, the dispenser can be easily adapted to dispense different fluid quantities by simply varying the dimensions of the tubular wall of the bush and consequently of the piston.

The dispenser can be constructed for operation by the finger of one hand (such as that shown on the drawing) or by a lever or the like, a known manner.

I claim:

1. A dispenser dispensing atomized fluids under pressure, provided with a shut-off element operated by the action of the pressurized fluid, comprising:

a hollow head provided with a seat connected onto a free end of a stem of a pump and in which is provided an elongate compression chamber in communication with said seat wherein said chamber is delimited at a first end thereof by a body positioned in the head and traversed by a hole through which fluid is discharged into the atmosphere, a piston moveable housed in said chamber and provided with a seal lip which delimits a second end of the compression chamber, an appendix projecting from said piston a spring housed in said hollow head and acting on the piston, said appendix having a free end which is biased by said spring and closes said discharge hole and said appendix being withdrawable from said hole into a dispensing position by the action of the pressurized fluid when fed into said chamber and acting on the piston against the action of said spring to allow the pressurized fluid to emerge in an atomized state from said chamber through said discharge hole, said head having a cavity which houses a bush traversed by a hole into which said piston appendix is inserted and through which said appendix extends, a tubular wall extending from said bush and defining a cavity in which a portion of the piston in proximity with said appendix is insertable in a slidable, sealed manner, a length dimension of said tubular wall and of said piston being such that a portion of the piston emerges from the cavity delimited by the tubular wall of the bush only after undergoing an extent of travel sufficient to enable said appendix to withdraw from said discharge hole so as to allow free emergence of pressurized liquid originating from said compression chamber through at least one channel provided within said bush and which is closable by the piston.

2. A dispenser as claimed in claim 1, wherein said portion of the piston which is insertable into and slidable in a sealed manner within the cavity in said bush is cylindrically shaped.

3. A dispenser as claimed in claim 2, wherein the cavity in the bush has a shape so as to interfere with said piston and be overcome in a snapwise fashion by the piston upon emergence of said piston from said cavity.

4. A dispenser as claimed in claim 1, wherein said cavity in the bush has a shape so as to interfere with said piston and be overcome snapwise by the piston upon emergence of said piston from said cavity.

* * * * *